US007657194B2

(12) United States Patent
Tanaka et al.

(10) Patent No.: US 7,657,194 B2
(45) Date of Patent: Feb. 2, 2010

(54) IMAGE FORMING APPARATUS AND TONER SUPPLY CONTROL PROGRAM FOR THE SAME

(75) Inventors: Tatsuya Tanaka, Nara (JP); Katsuhiro Nagayama, Nara (JP); Takashi Kitagawa, Nara (JP); Masayuki Otsuka, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 165 days.

(21) Appl. No.: 11/899,475

(22) Filed: Sep. 6, 2007

(65) Prior Publication Data

US 2008/0080878 A1 Apr. 3, 2008

(30) Foreign Application Priority Data

Sep. 28, 2006 (JP) ..... 2006-263801

(51) Int. Cl.
*G03G 15/08* (2006.01)

(52) U.S. Cl. ..... 399/30; 399/62

(58) Field of Classification Search ..... 399/27, 399/30, 58, 61, 62
See application file for complete search history.

(56) References Cited

U.S. PATENT DOCUMENTS

2006/0285861 A1* 12/2006 Kunikawa ..... 399/27
2008/0019712 A1* 1/2008 Tanaka et al. ..... 399/30

FOREIGN PATENT DOCUMENTS

| | | |
|---|---|---|
| JP | 09-160364 | 6/1997 |
| JP | 09-185239 | 7/1997 |
| JP | 2001-183894 | 7/2001 |
| JP | 2006-171177 | 6/2006 |

* cited by examiner

*Primary Examiner*—Sophia S Chen
(74) *Attorney, Agent, or Firm*—David G. Conlin; Steven M. Jensen; Edwards Angell Palmer & Dodge LLP

(57) ABSTRACT

A digital color copier includes: a toner concentration storage which stores a detected toner concentration of each developer block of multiple developer blocks across an image forming width; a toner consumption predictor for predicting a first predicted toner consumption of toner consumed from developer of every developer block during a first circulation; a toner concentration estimator for estimating, for every developer block, a toner supply point estimate as the toner concentration at a point where toner is supplied, by subtracting the first predicted toner consumption from the associated detected toner concentration and setting up a toner supply target value of the toner to be supplied from a toner supply device to a developing device in accordance with the predicted toner consumption during a second circulation of the developer inside the developing device that follows the first circulation.

12 Claims, 13 Drawing Sheets

IMAGE FORMING APPARATUS AND TONER SUPPLY CONTROL PROGRAM FOR THE SAME

This Nonprovisional application claims priority under 35 U.S.C. §119(a) on Patent Application No. 2006-263801 filed in Japan on 28 Sep. 2006, the entire contents of which are hereby incorporated by reference.

BACKGROUND OF THE INVENTION (1) Field of the Invention

The present invention relates to an image forming apparatus such as a copier, facsimile machine, printer or the like and a toner supply control program used for the apparatus. In particular, the present invention relates to an image forming apparatus for performing image forming using a dual-component developer consisting of a toner and a carrier and a toner supply control program used for the apparatus.

(2) Description of the Prior Art

Conventionally, in an image forming apparatus of electrophotograpic type such as a copier, facsimile machine, printer and the like, a photoreceptor drum as an image support is uniformly electrified by a charger device, then an electrostatic latent image is formed on the photoreceptor drum. This electrostatic latent image is developed by the developing device and visualized into a toner image, which in turn is transferred to a recording medium in the transfer station. Then the recording medium is conveyed through the fixing unit, where the toner image is fixed to the recording medium, and is output as a printed image.

In the thus configured image forming apparatus, when a dual-component developer consisting of a toner and a carrier is used as its developer, only the toner is consumed for image forming, so that it is necessary to keep the toner concentration in the developing unit constant.

To deal with this, the image forming apparatus using the dual-component developer usually includes: a toner concentration sensor such as a sensor for detecting the toner concentration in the developer, a sensor for detecting the density of the toner image formed on the photoreceptor drum or the like; and a toner supply device for supplying toner from a toner supply container into the developing device in accordance with a detected signal issued when the fact that the toner concentration has fallen to a reference level or lower is detected by the toner concentration sensor, so that a suitable amount of toner is supplied in accordance with the amount of toner that has been used as image output has proceeded.

As for the above toner supplying techniques, some proposals have been made conventionally. For example, there is a proposal in which, the recording width L on the photoreceptor drum is divided into N blocks and the number of pixels to be written in for every width L/N is summed up and stored in association with the developer's speed of movement, Vz, in the axial direction of the developing roller, so as to estimate the amount of toner consumption, to thereby achieve toner supply without using any toner concentration detecting sensor (patent document 1: Japanese Patent Application Laid-open Hei 9 No. 160364). There is also another proposal in which, a plurality of toner loading ports for toner supply are arranged along the axial direction of the developing roller, and toner is loaded to the areas where toner has been consumed, through the ports where toner has been consumed more greatly to thereby keep the toner concentration constant (patent document 2: Japanese Patent Application Laid-open No. 2001-183894).

However, as to patent document 1, there is a fear that the error of toner concentration will build up since no toner concentration detecting sensor is used, and there is the problem of the accuracy of estimation of the toner consumption being not good enough since the number of pixels is counted line by line. There is also the problem that no leveling off of the toner concentration from the neighboring blocks due to toner agitation is considered.

On the other hand, in patent document 2, since the toner supply device has a complicated configuration, there is the problem and concern that the toner loaded through multiple toner loading ports cannot be agitated sufficient enough.

SUMMARY OF THE INVENTION

The present invention has been devised in view of the conventional problems, it is therefore an object of the present invention to provide an image forming apparatus and a toner supply control program for use in the apparatus, which, by use of a simple configuration, can perform suitable toner supply by estimating the amount of toner consumption based on the printing image data and predicting the toner concentration at the areas where toner is consumed.

According to the present invention, the image forming apparatus and the toner supply control program for use in the apparatus for solving the above problems are configured as follows.

An image forming apparatus according to the first aspect of the present invention includes: an image support on which an electrostatic latent image is formed; a developing device for visualizing the electrostatic latent image by adhering toner to the electrostatic latent image on the image support by means of a developing roller; an image storage for storing image information to be printed; an exposure device for forming the electrostatic latent image on the image support in accordance with the image information stored in the image storage; a toner concentration detector (e.g., toner concentration sensor) for detecting the toner concentration of the developer in the developing device; a toner supply device for supplying the toner to the developing device based on the toner concentration obtained by the toner concentration detector, wherein the image forming apparatus is controlled so that the toner is supplied to the developing device in accordance with the amount of toner that has been consumed as the image output proceeds; a toner concentration storage (e.g., concentration memory) which, as to a plurality of developer blocks into which the developer that circulates in the developer device is virtually divided across the image forming width, stores the detected toner concentration of each developer block, detected by the toner concentration detector, separately for every developer block; a toner consumption predictor for predicting the first predicted toner consumption of the toner that is expected to be consumed and/or was consumed from the developer of every developer block during the first circulation in accordance with the image information, based on the developer's speed of conveyance in the developing device and the print processing speed; and a toner concentration estimator for estimating, for every developer block, the toner supply point estimate as the toner concentration at the point where toner is supplied, by subtracting the first predicted toner consumption from the associated detected toner concentration and setting up a toner supply target value of the toner to be supplied from the toner supply device to the developing device in accordance with the predicted toner consumption during the second circulation that follows the first circulation, of the developer inside the developing device.

An image forming apparatus according to the second aspect of the present invention, in addition to the above first configuration of the present invention, further includes: a predicted toner consumption storage for storing the first predicted toner consumption, wherein the predicted toner consumption storage stores the first predicted toner consumption at the time of test printing, and the toner concentration estimator, at the time of real printing, sets up the toner supply target value based on the first predicted toner consumption stored in the predicted toner consumption storage.

An image forming apparatus according to the third aspect of the present invention is characterized in that, in addition to the above first configuration of the present invention, the toner concentration estimator, based on the second predicted toner consumption of the toner that is expected to be consumed during the second circulation, sets up the toner supply target value.

An image forming apparatus according to the fourth aspect of the present invention is characterized in that, in addition to the above first configuration of the present invention, the toner concentration estimator, based on the transition of the toner consumption during the second circulation, sets up the toner supply target value.

An image forming apparatus according to the fifth aspect of the present invention is characterized in that, in addition to the above first configuration of the present invention, the toner consumption predictor, based on the predicted unit toner consumptions of individual image blocks into which expected output images are divided rectangularly and based on the print-designated image blocks, for which toner is expected to be, and/or has been, consumed during the first circulation, and which are designated in accordance with the developer's speed of conveyance in the developing device and the print processing speed, sums up the predicted unit toner consumptions for the print-designated image blocks, to thereby estimate the first predicted toner consumption.

An image forming apparatus according to the sixth aspect of the present invention is characterized in that, in addition to the above fifth configuration of the present invention, the toner consumption predictor adds a predetermined weight to each of the print-designated image blocks when summing up the predicted unit toner consumptions of the print-designated image blocks.

An image forming apparatus according to the seventh aspect of the present invention is characterized in that, in addition to the above fifth configuration of the present invention, the developing device is designed such that the period of time in which the developer is conveyed and circulated one round inside the device is set to be an integer multiple of the print processing time required for image forming of a single page of expected output image.

An image forming apparatus according to the eighth aspect of the present invention is characterized in that, in addition to the above first configuration of the present invention, the developer device includes a toner conveyor for agitating and conveying the developer stored therein in the axial direction of the developer roller; and the developing device has an toner input port for receiving toner from the toner supply device, at a position opposing the toner conveyor and located on the upstream side with respect to the toner's direction of conveyance.

An image forming apparatus according to the ninth aspect of the present invention is characterized in that, in addition to the above eighth configuration of the present invention, the toner concentration detector is arranged at a position opposing the toner conveyor and located on the downstream side with respect to the toner's direction of conveyance.

An image forming apparatus according to the tenth aspect of the present invention is characterized in that, in addition to the above first configuration of the present invention, the developer blocks of which the first predicted toner consumptions are predicted are identified based on the time interval from the start of forming the electrostatic latent image onto the image support to the start of developing the electrostatic latent image.

An image forming apparatus according to the eleventh aspect of the present invention is characterized in that, in addition to the above fifth configuration of the present invention, the print-designated image blocks are determined based on the developer block's timing of conveyance, the exposure timing of image data in the image area and the time lag that is required for toner to transfer from each developer block and to be consumed.

A toner supply control program according to the twelfth aspect of the present invention is used for an image forming apparatus that comprises: an image support on which an electrostatic latent image is formed; a developing device for visualizing the electrostatic latent image by adhering toner to the electrostatic latent image on the image support by means of a developing roller; an image storage for storing image information to be printed; an exposure device for forming the electrostatic latent image on the image support in accordance with the image information stored in the image storage; a toner concentration detector for detecting the toner concentration of the developer in the developing device; and a toner supply device for supplying the toner to the developing device based on the toner concentration obtained by the toner concentration detector, the toner supply program being executed to supply the toner to the developing device in accordance with the amount of toner that has been consumed as the image output proceeds, includes: for a plurality of developer blocks into which the developer that circulates in the developer device is virtually divided across the image forming width, a step of storing the detected toner concentration of each developer block, detected by the toner concentration detector, separately for every developer block; a step of predicting the first predicted toner consumption of the toner that is expected to be consumed and/or was consumed from the developer of every developer block during the first circulation in accordance with the image information, based on the developer's speed of conveyance in the developing device and the print processing speed; a step of estimating, for every developer block, the toner supply point estimate as the toner concentration at the point where toner is supplied, by subtracting the first predicted toner consumption from the associated detected toner concentration; and a step of setting up a toner supply target value of the toner to be supplied from the toner supply device to the developing device in accordance with the predicted toner consumption during the second circulation that follows the first circulation, of the developer inside the developing device.

According to the first aspect of the invention, it is possible to realize an image forming apparatus which, by use of a simple configuration, can perform suitable toner supply by estimating the amount of toner consumption based on the printing image data and predicting the toner concentration at the areas where toner is consumed, without complicating the toner supply device configuration.

According to the second to fifth, eighth and tenth aspects of the invention, it is possible to obtain the following effects in addition to the above common effect obtained from the first aspect of the invention.

That is, according to the second aspect of the invention, it is possible to make the necessary control even if the images corresponding to toner consumption estimation has not been expanded at the time of image output (printing) during the second circulation.

According to the third aspect of the invention, the process of toner supply control can be made simple.

According to the fourth aspect of the invention, use of the least square method or the like enables the toner concentration to approach the target value over as a wide range as possible.

According to the fifth aspect of the invention, the operating process for predicting toner consumption can be made easy.

According to the sixth aspect of the invention, in addition to the effect obtained from the fifth aspect of the invention it is possible to determine the expected amount of toner consumption with precision.

According to the seventh aspect of the invention, in addition to the effect obtained from the fifth aspect of the invention, it is possible to predict toner consumption for every developer block. Further, it is possible to reduce the number of combinations of image blocks for summation.

According to the eighth aspect of the invention, since it is possible to lengthen the toner conveyance path of the supplied toner to reach the developing roller, the toner can be agitated sufficiently enough and hence electrified accordingly.

According to the ninth aspect of the invention, in addition to the effect obtained from the eighth aspect of the invention, since measurement of toner concentration is made after the toner supplied to the toner conveyor has been sufficiently agitated while being conveyed, it is possible to achieve precise measurements of toner concentration.

According to the tenth aspect of the invention, it is possible to predict toner consumption for every developer block.

According to the eleventh aspect of the invention, in addition to the effect obtained from the fifth aspect of the invention it is possible to predict toner consumption for every developer block.

According to the twelfth aspect of the invention, it is possible, by use of a simple configuration, to perform suitable toner supply by estimating the amount of toner consumption based on the printing image data and predicting the toner concentration at the areas where toner is consumed, without complicating the toner supply device configuration.

DESCRIPTION OF THE PREFERRED EMBODIMENTS

The embodiment of the present invention will hereinafter be described with reference to the accompanying drawings.

Figure 1:
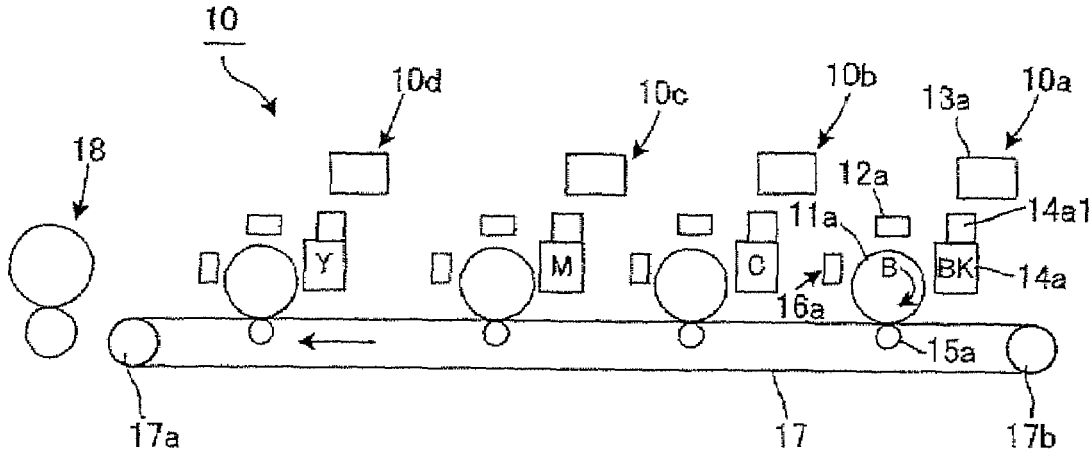
FIG. 1 is a schematic diagram showing a configuration of an image forming portion of a digital color copier as an image forming apparatus according to the present embodiment.

FIG. 1 is a schematic diagram showing a configuration of an image forming portion of a digital color copier as an image forming apparatus according to the present embodiment.

It should be noted that this invention can be similarly applied to other types of image forming apparatus such as printers, facsimile machines etc., which perform electrophotographic image forming, other than the above digital color copier.

The digital color copier reads a color image from a document with an unillustrated scanner portion, effects predetermined image processes, then supplies the processed data as image data to an image forming portion 10, to thereby reproduce the color image that was picked up from the document onto a recording medium such as paper or the like.

Image forming portion 10 of the digital color copier includes a transfer and conveyance belt 17 that is wound and stretched between a pair of rollers 17*a* and 17*b* with its top and bottom kept horizontal and is rotated in a direction of an arrow (see FIG. 1). Transfer and conveyance belt 17, when it is located at top horizontal portion, conveys the paper placed on the top surface thereof sequentially along, and opposite to, multiple image forming stations 10*a* to 10*d*, as the belt rotates in the direction of the arrow. Image forming stations 10*a* to 10*d* each effect electrophotographic image forming with toners of black and the three subtractive primary colors (cyan, magenta and yellow), respectively.

Arranged on the downstream side of roller 17*a* located at one end of transfer and conveyance belt 17 is a fixing unit 18. Fixing device 18 is formed of a pair of rollers so as to fuse the toner image that was transferred on the paper and fix it to the paper surface by heating and pressing the paper that has passed through all image forming stations 10*a* to 10*d*.

Image forming stations 10*a* to 10*d* all have identical configurations except for the amount of stored toner.

Here, the image forming stations according to the present embodiment will be described taking as an example image forming station 10*a*.

Image forming station 10*a*, as shown in FIG. 1, has a photoreceptor drum (toner image support) 11*a* that is formed of a cylindrical conductive base and a photoconductive layer formed thereon and rotates in a direction of arrow B, and further includes a charger 12*a*, an exposure unit (exposure device) 13*a*, a developing unit (developing device) 14*a*, a transfer device 15*a*, a cleaner 16*a* and others, all being arranged around the photoreceptor drum in the order mentioned.

Charger 12*a* uniformly applies electricity of a predetermined polarity over the photoreceptor drum 11*a* surface.

Exposure unit 13*a* forms an electrostatic latent image by irradiating an image of light over the photoreceptor drum 11*a* surface.

Developing unit 14*a*, while it is circulating and conveying the toner stored therein, supplies the toner to the photoreceptor drum 11*a* surface so as to visualize the electrostatic latent image into a toner image. Provided inside developing unit 14*a* is a toner concentration sensor (toner concentration detecting means) 14*a*3 (see FIG. 5) as a toner concentration detecting means for detecting the toner concentration of the developer stored therein.

Arranged above developing unit 14*a* is a toner supply device 14*a*1 for supplying toner to developing unit 14*a*. Toner supply device 14*a*1 is controlled so as to supply toner in accordance with the amount of toner that is consumed as image output proceeds, based on the toner concentration obtained from toner concentration sensor 14*a*3.

Transfer device 15*a* is arranged opposing the peripheral surface of photoreceptor drum 11*a* with transfer and conveyance belt 17 therebetween and causes the toner image supported on the photoreceptor drum 11*a* surface to transfer to the paper surface carried on transfer and conveyance belt 17.

Cleaner 16*a* removes the toner residing on the peripheral surface of photoreceptor drum 11*a* after completion of the transfer step.

Developing unit 14*a* includes a developing roller 14*a*2 (see FIG. 2) that rotates opposing the peripheral surface of photoreceptor drum 11*a*. This developing roller 14*a*2 carries toner on its surface and supplies the toner to the peripheral surface of photoreceptor drum 11*a* as it rotates. The peripheral speed of this developing roller 14*a*2, or its rotational speed can be changed so as to vary the supplied amount of toner to the peripheral surface of photoreceptor drum 11*a*, hence control the toner image density.

Supplied to exposure units 12*a* to 12*d* provided for image forming stations 10*a* to 10*d* are color image data of black, cyan, magenta and yellow, respectively while developing units 14*a* to 14*d* each hold a toner of corresponding color, i.e., black, cyan, magenta or yellow. Accordingly, image forming stations 10*a* to 10*d* sequentially transfer respective colors of toner images, i.e., black, cyan, magenta and yellow images, to a sheet of paper, so as to create a full color image on the paper passing through fixing unit 18 by subtractive color mixture of the toner images of individual colors.

Next, the configuration of developing unit 14*a* according to the present embodiment will be described with reference to the drawings.

Figure 2:
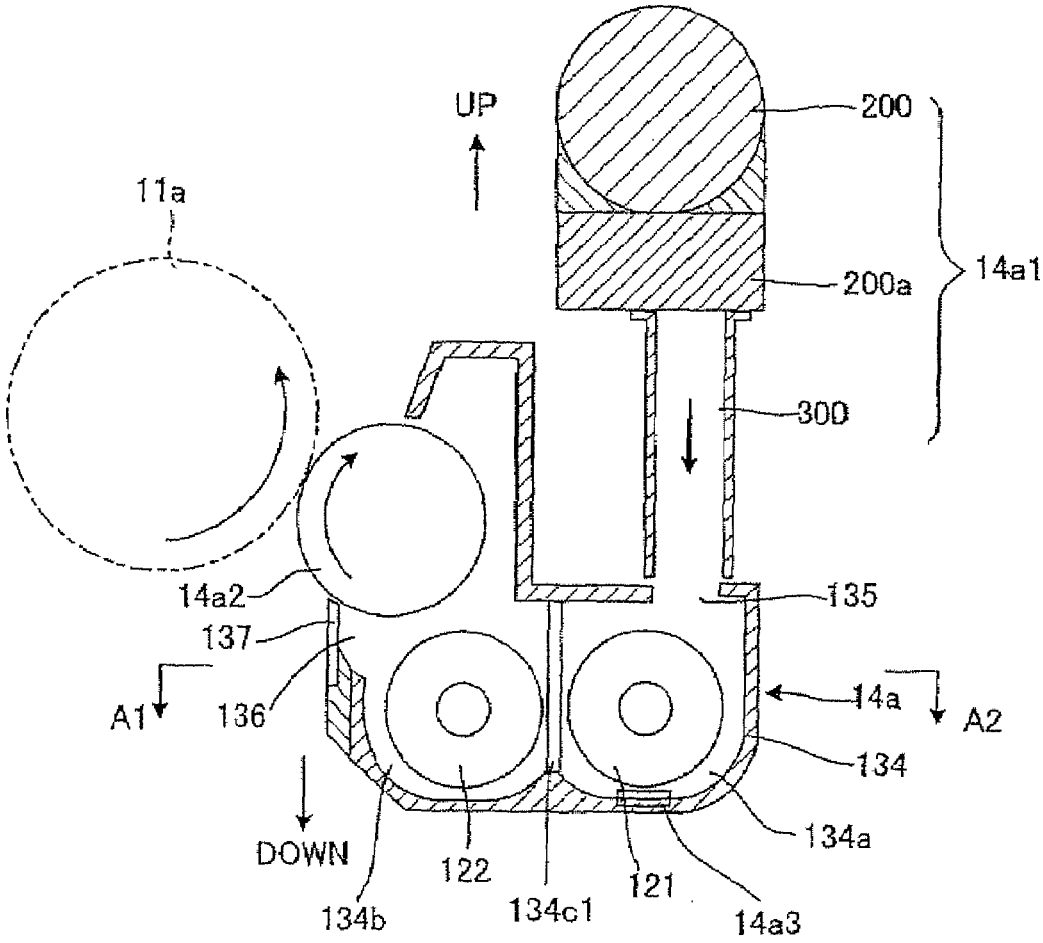
FIG. 2 is a sectional side view showing a configuration of a developing unit as a part of an image forming station of the digital color copier.
Figure 3:
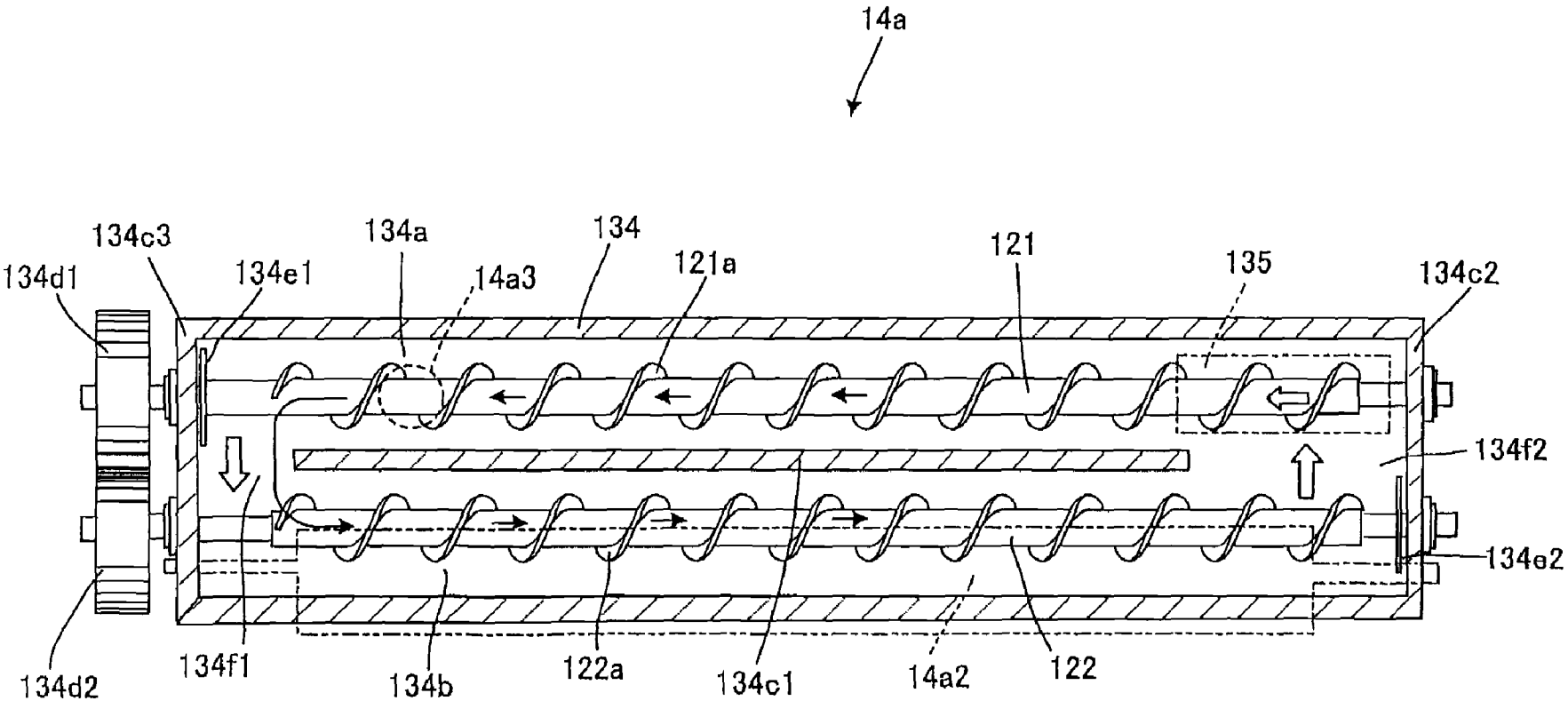
FIG. 3 is a sectional view, cut along the plane A1-A2 in FIG. 2, showing the configuration of the developing unit.

FIG. 2 is a sectional side view showing a configuration of a developing unit as a part of an image forming station according to the present embodiment, and FIG. 3 is a sectional view, cut along the plane A1-A2 in FIG. 2, showing the configuration of the developing unit.

As shown in FIGS. 2 and 3, in developing unit 14*a*, a casing 134 forming its exterior is formed at the top thereof with an opening as a toner input port 135 for receiving the developer while a developing roller 14*a*2, first toner conveying roller 121 and second toner conveying roller 122 are arranged inside casing 134. This developing unit 14*a* is mounted to the image forming apparatus body with the aforementioned developing roller 14*a*2 placed opposing and in abutment with or close to photoreceptor drum 11*a*.

Casing 134 is a box-shaped configuration elongated in the direction (the width direction of the transfer and conveyance belt 17) perpendicular to the direction of transfer (direction of movement A of the transfer and conveyance belt 17) when mounted in the image forming apparatus body, and is formed with an opening mouth 136 so that developing roller 14*a*2 therein opposes photoreceptor drum 11*a* when developing unit 14*a* is mounted to the image forming apparatus body.

Opening mouth 136 is made open across the width of casing 134 along the direction in which the axis of developing roller 14*a*2 extends (to be referred to hereinbelow as "the axis direction" in short) so that at least developing roller 14*a*2 will be able to oppose and abut photoreceptor drum 11*a*. Provided along the bottom edge of opening mount 136 in FIG. 2 is a blade 137 that extends in the axis direction of developing roller 142*a*.

Blade 137 is positioned so as to create a predetermined clearance between the free end of blade 137 and the developing roller 14*a*2 surface, whereby a predetermined amount of toner can be supplied to the developing roller 14*a*2 surface through this clearance.

The interior of casing 134 is divided into a first toner chamber (toner reservoir) 134*a* with first toner conveying roller 121 disposed therein and a second toner chamber (toner reservoir) 134*b* with second toner conveying roller 122 disposed therein, by a partitioning element 134*c*1.

As shown in FIG. 2, a toner concentration sensor 14*a*3 is arranged at a position opposing first conveying roller 121 in the bottom of first toner chamber 134*a*. Detailedly, toner concentration sensor 14*a*3 is arranged on the downstream side, with respect to the toner conveying direction of first toner conveying roller 121, from the center of casing 134 and closer to one end side 134*c*3, as shown in FIG. 3.

That is, toner concentration sensor 14*a*3 is adapted to perform detection of toner concentration after the toner supplied to first toner conveying roller 121 has been sufficiently agitated.

First toner conveying roller 121 and second toner conveying roller 122 are arranged in the bottom inside casing 134, parallel to each other along the axis direction of developing roller 14*a*2 and agitate the toner that is supplied into casing 134 with the remaining developer and convey the mixture to developing roller 14*a*2 (FIG. 2) while moving the developer in the axis direction. Developing roller 14*a*2 is arranged over and above second toner conveying roller 122 so as to be exposed from opening mouth 136.

First and second toner conveying rollers 121 and 122 have screws 121*a* and 122*a* for agitating and conveying toner, respectively, as shown in FIG. 3, and are driven to rotate by an unillustrated drive motor by way of drive gears 134*d*1 and 134*d*2 arranged on the other side, 134*c*3, of casing 134.

Here, the means of agitating and conveying toner as above should not be limited to screws 121*a* and 122*a*. For example, it may be a structure in which a multiple number of agitating vanes tilted with the direction of toner conveyance are formed on the first and second toner conveying rollers 121 and 122. Also any other configuration can be used as long as it can achieve the same effect.

Further, toner receiving plates 134*e*1 and 134*e*2 are arranged with first and second toner conveying rollers 121 and 122, at respective downstream side ends with respect to the direction of toner conveyance, so as to receive the conveyed toner.

Partitioning element 134*c*1 is formed in casing 134 along the casing length or along the first and second conveying rollers 121 and 122, having toner chamber communication ports 134*f*1 and 134*f*2 formed near both the casing 134's side walls to allow for communication between first and second toner chambers 134*a* and 134*b*.

These toner chamber communication ports 134*f*1 and 134*f*2 permit toner to circulate in the direction shown by the arrows in the drawing, from first toner chamber 134*a* to second toner chamber 134*b* and from second toner chamber 134*b* to first toner chamber 134*a*. The toner communication passage made up of first toner chamber 134*a* and toner chamber communication port 134*f*1, second toner chamber 134*b* and toner chamber communication port 134*f*2 will be called hereinbelow "toner circulating path".

Arranged on top of casing 134 close to one end side 134*c*2 is a toner input port (toner input portion) 135 for receiving toner supplied from toner supply device 14*a*1 arranged above.

As shown in FIG. 3, the opening of toner input port 135 is formed at a position (close to one end side 134*c*2) opposing part of first toner conveying roller 121 for agitating and conveying toner from the first end side 134*c*2 to the second end side 134*c*3 of casing 134.

In other words, the position of toner supply (toner input port 135) is designed so as to supply toner from the upstream side with respect to the toner conveying direction of first toner conveying roller 121 that is located on the far side from developing roller 14*a*2 (FIG. 2), whereby the supplied toner can be sufficiently agitated and electrified until the toner reaches developing roller 14*a*2.

Toner supply device 14*a*1 (FIG. 2) is laid out over and above the thus constructed developing unit 14*a*.

As shown in FIG. 2, toner supply device 14*a*1 is essentially comprised of an approximately cylindrical toner bottle (toner container) 200 for storing toner as the developer and a toner supply portion 200*a* for rotatably supporting the toner bottle 200 on its one end side, so as to supply the toner to developing unit 14*a* through a toner supply passage part 300 that is coupled to developing unit 14*a*.

Next, the control system of the digital color copier according to the present embodiment will be described with reference to the drawings.

Figure 4:
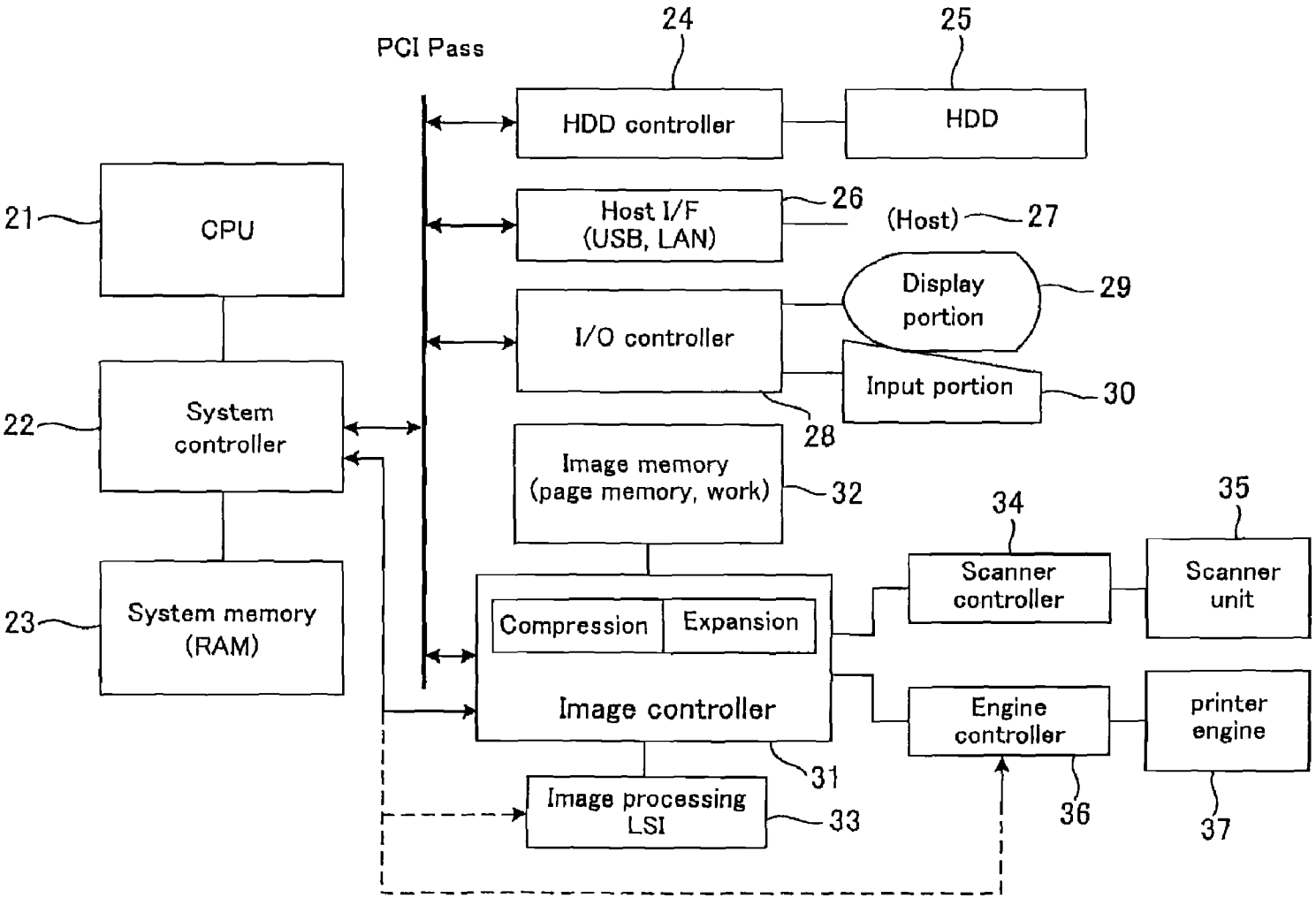
FIG. 4 is a block diagram showing an electric controller configuration of the digital color copier.

FIG. 4 is a block diagram showing an electric controller configuration of the digital color copier according to the present embodiment.

As shown in FIG. 4, the digital color copier includes a central processing unit (CPU) 21 which, by way of a system controller 22 using a system memory 23, integrally controls the operating processes of a HDD controller 24, a host I/F (USB, LAN etc.) 26, an I/O controller 28, an image controller 31 and others, all being connected by a PCI bus.

HDD controller 24 controls the operation of HDD (Hard disk) 25.

Host I/F (USB, LAN etc.) 26 is connected to a host (host computer) 27 and exchanges signals with it.

I/O controller 28 controls the output operations on a display portion 29 of the apparatus and input signals that are input through an input portion 30 such as a control panel and the like.

Image controller 31 controls operations for imaging, including: writing the input image information (image data) into an image memory (image storage and toner concentration storage) 32; performing image processing by means of an image processing LSI (Large Scale Integration) 33; image reading by controlling a scanner unit 35 by way of a scanner controller 34; and controlling the operation of a printer engine 37 by way of an engine controller 36.

Next, the characteristic configuration for performing toner supply control to supply toner to developing unit 14*a* of the present embodied mode in the digital color copier according to the present embodiment will be described in detail.

Figure 5:
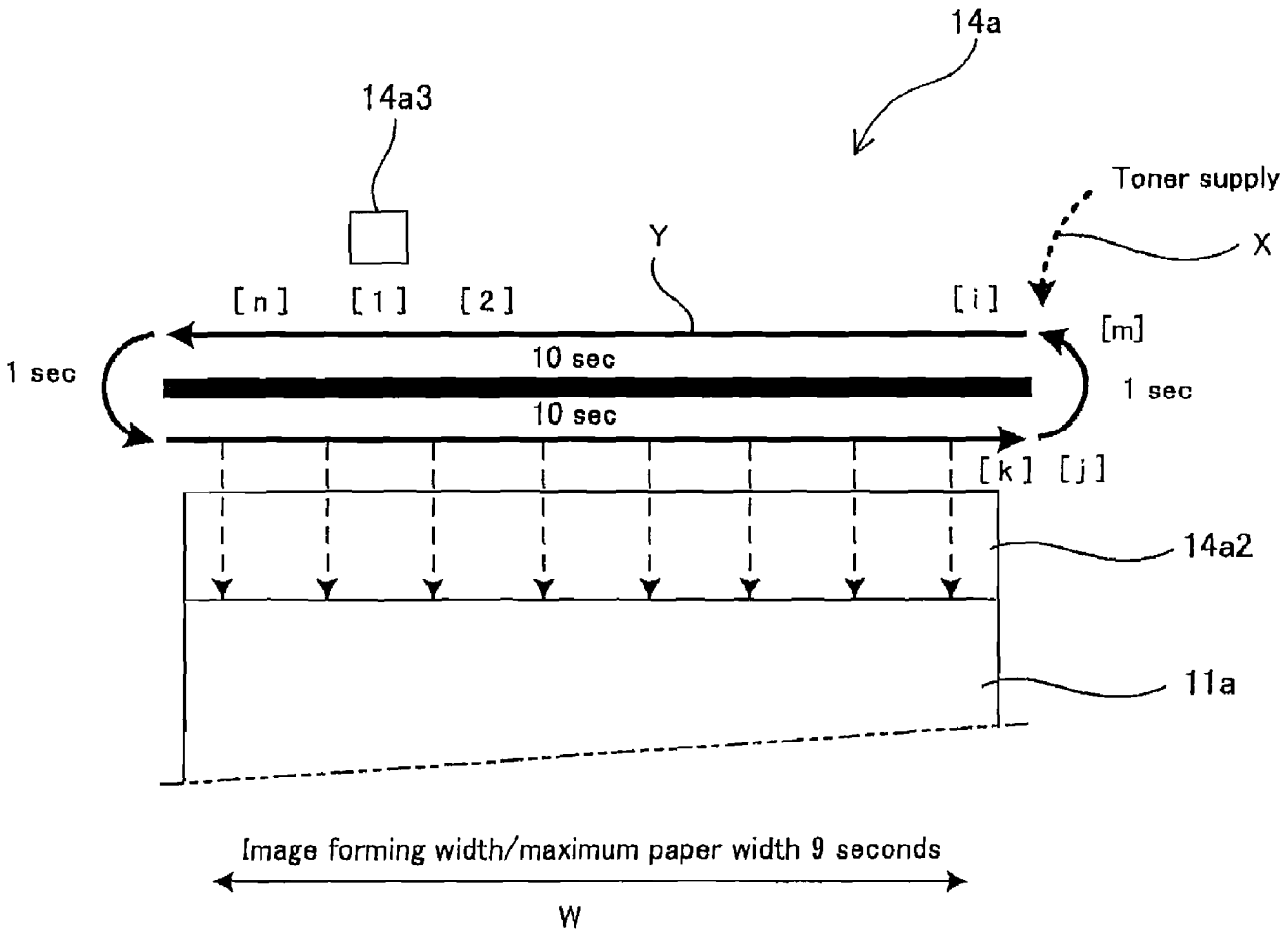
FIG. 5 is a schematic diagram for illustrating conveyance of the developer stored inside a developing unit as a part of a digital color copier and toner concentration detection.
Figure 6:
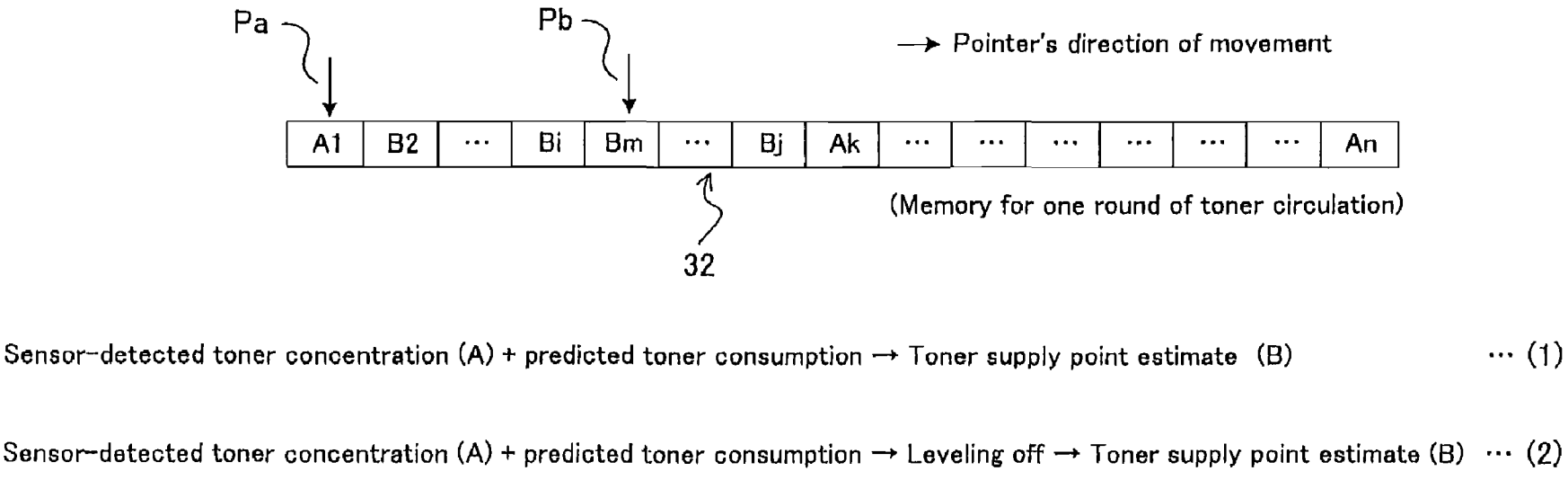
FIG. 6 is an illustrative diagram showing the relationship between the measurements detected by a toner concentration sensor and the toner concentration estimates at a toner supply point, both being stored in an image memory as a part of the digital color copier.
Figure 7:
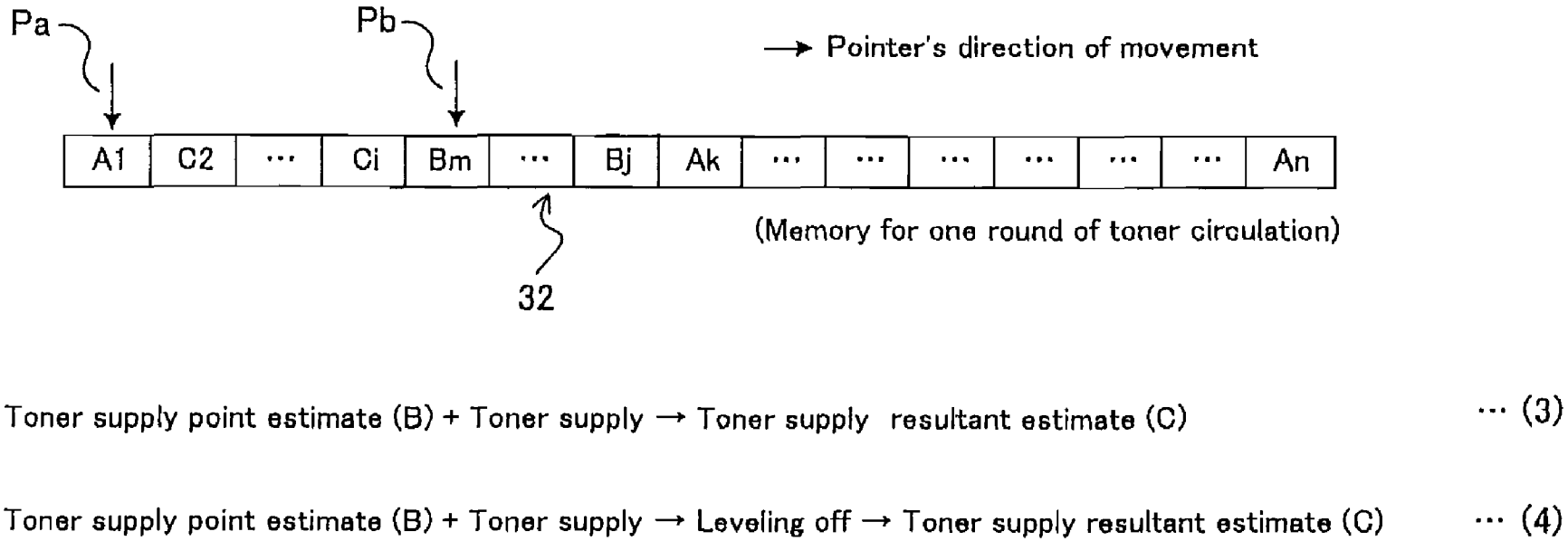
FIG. 7 is an illustrative diagram showing the relationship between the toner concentration estimates at the toner supply point and the toner concentration estimates as a result of toner supply, both being stored in the image memory.

FIG. 5 is a schematic diagram for illustrating conveyance of the developer stored in a developing unit as a part of a digital color copier according to the present embodiment and toner concentration detection; FIG. 6 is an illustrative diagram showing the relationship between the measurements detected by a toner concentration sensor and the toner concentration estimates at toner supply point 135, both being stored in an image memory as a part of the digital color copier; and FIG. 7 is an illustrative diagram showing the relationship between the toner concentration estimates at the toner supply point and the toner concentration estimates as a result of toner supply, both being stored in the image memory.

As shown in FIG. 5, in the digital color copier, in accordance with the amount of toner consumed as image output proceeds, toner is supplied from toner supply device 14*a*1 (FIG. 2) to one end part (as indicated by an dashed arrow X) with respect to the direction in which the image forming width W of developing unit 14*a* extends (to be referred to as "image forming width direction").

The developer inside developing-unit 14*a* is circulatively conveyed along the solid arrows Y through the toner circulating path (134*a*, 134*f*1, 134*b* and 134*f*2: FIG. 3), and is assumed to be divided virtually into multiple developer blocks (1 to n), along the flow of conveyance.

Inside developing unit 14*a*, toner concentration sensor 14*a*3 is disposed at a position downstream, with respect to the direction of toner conveyance, of the center of the image forming width along the axis of developing roller 14*a*2. This toner concentration sensor 14*a*3 is adapted to detect toner concentration for every developer block (1 to n) as the toner is conveyed. Provision of toner concentration sensor 14*a*3 at the position specified above permits detection on the toner concentration after the toner supplied from toner input port 135 has been sufficiently agitated and mixed with the carrier.

Further, the developer's speed of conveyance in the developing unit 14*a* and the print processing speed are set so that the time required for the developer to be conveyed one round of the toner circulating path is equal to an integer multiple of the print processing time required for one page of image forming. Here, the print processing time is the processing time taken from the start of forming an electrostatic latent image (of a unit size) on photoreceptor drum 11*a* by means of exposure unit 13*a* until the completion of development of the electrostatic latent image (of a unit size) by means of developer roller 14*a*2. The print processing speed is the number of copied pages per unit period of time.

For example, if a digital color copier has an image output capacity of 30 pages per minute and when it takes 22 seconds to convey the developer one round of the toner circulating path, 11 sheets of recording paper can be output while the developer makes the one round of the toner circulating path. Alternatively, if a digital color copier has an image output capacity of 20 pages per minute and when it takes 9 seconds to convey the developer across the image forming width W of developing unit 14*a*, 3 sheets can be output while the developer is conveyed from one end to the other of the image forming width.

Further, the digital color copier according to the present invention includes a toner concentration storage, a toner consumption predictor, a predicted toner consumption storage, a toner concentration estimator, a toner supply timing determining portion and a toner supply controller.

(Toner Concentration Storage)

A toner concentration storage is composed of a plurality of storage elements (memories), each storing the toner concentration (A1 to An) of one of the individual developer blocks (1 to n), as shown in FIGS. 6 and 7. In the present embodiment, these plural storage elements are configured in an image memory 32 (FIG. 4), so that the image memory 32 also functions as the toner concentration storage.

A symbol Pa in the drawing designates the position at which toner concentration is detected by toner concentration sensor 14*a*3 and Pb designates the position of toner supply point 135 at which toner is supplied from toner supply device 14*a*1.

Symbols A1 to An denote the sensor-detected values of the toner concentration of individual developer blocks (1 to n), detected by toner concentration sensor 14*a*3 (to be referred to hereinbelow as "sensor-detected toner concentration values").

Symbols B1 to Bn (including those not shown in the drawings) indicate the estimated toner concentration values of individual developer blocks (1 to n) at toner supply point 135 (to be referred to hereinbelow as "toner supply point estimates"). The detail of toner supply point estimate B will be described later.

Symbols C1 to Cn (including those not shown in the drawings) indicate the estimated toner concentration values of individual developer blocks (1 to n) after toner was supplied at toner supply point 135 (to be referred to hereinbelow as "toner supply resultant estimates"). The detail of toner supply resultant estimate C will be described later.

(Toner Consumption Predictor)

A toner consumption predictor has a function of predicting (calculating) the first toner consumption that is expected to be used while the developer of each developer block (1 to n) makes one round, specifically, the first circulation, of the toner circulating path, from the expected output image information to be printed hereinafter, which has been stored in image memory 32 (the aforementioned image storage), based on the developer's speed of conveyance in developing unit 14*a* and the print processing speed.

It should be noted that the first toner consumption, instead of being estimated from the expected output image information, may be estimated (calculated) from the image information that has been already printed out. It is also possible to calculate the first toner consumption that was consumed while the developer of each developer block (1 to n) made one round during the first circulation (the N-th round, N: an integer equal to or greater than 1 (1, 2, 3, . . . )), based on the combination of the expected output image information and the printed out image information. That is, it is acceptable if the first toner consumption has been determined before the toner concentration estimator starts the process using the first toner consumption.

In the present embodiment, image controller 31 (FIG. 4) is made to serve as a toner consumption predictor by providing the above-described function to image controller 31.

Since the method of calculating the first toner consumption is not different between the case where the expected output image information is used and the case where the printed out image information is used, the method of calculating the first toner consumption using the expected output image information will be described hereinbelow.

The toner consumption predictor divides the expected output image into a plurality of rectangular image blocks, and determines the predicted first toner consumption that will be supplied to or consumed by all the image blocks while each developer block passes through the image forming width W (FIG. 5).

Figure 13:
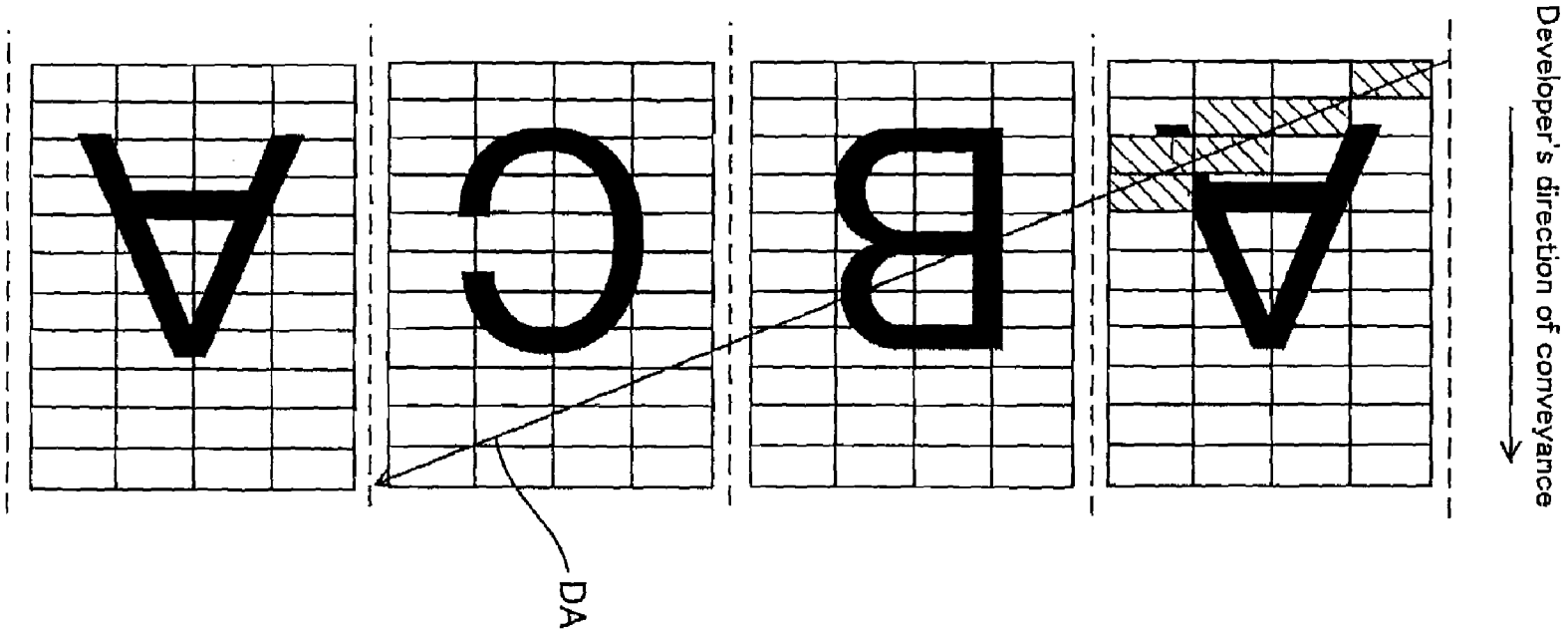
FIG. 13 is an illustrative diagram showing an example in which images to be output are divided into image blocks and printed out.
Figure 14:
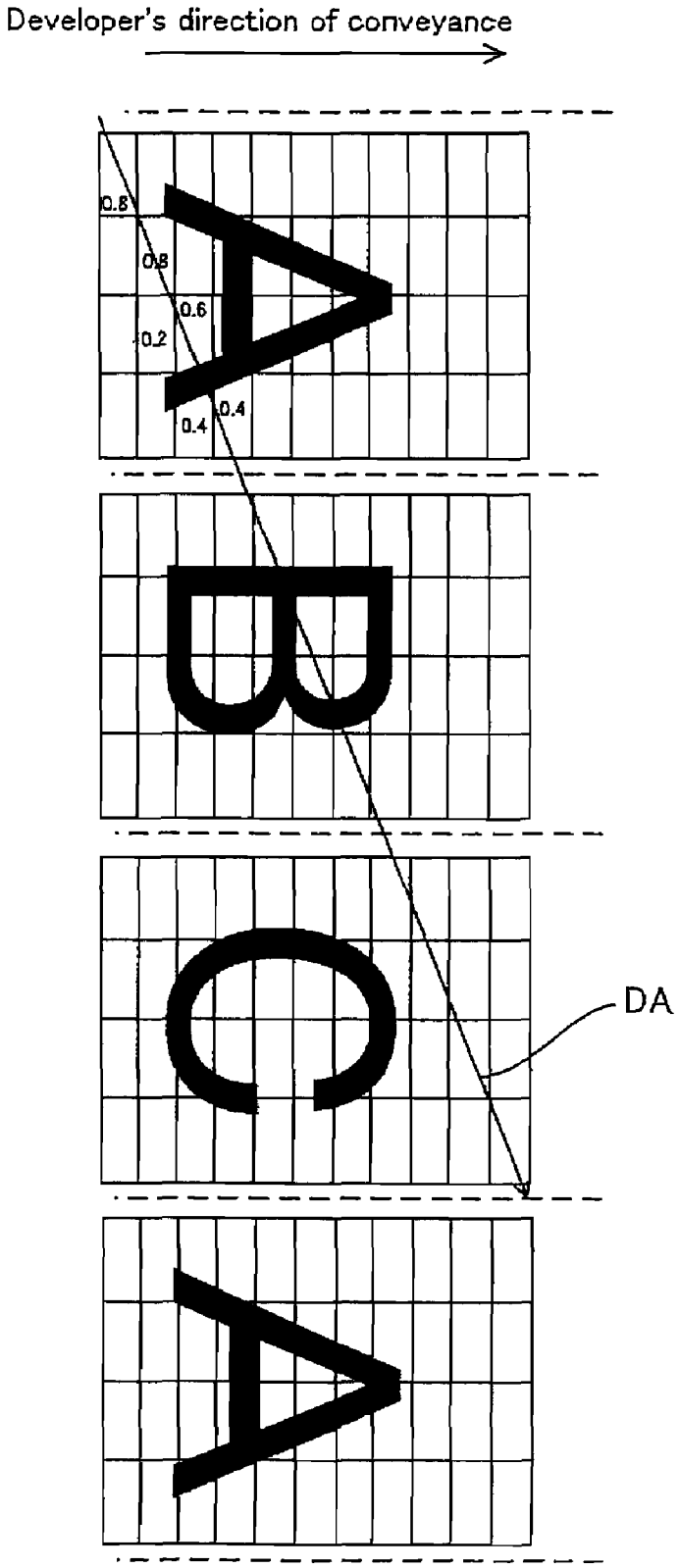
FIG. 14 is an illustrative diagram showing another example in which images to be output are divided into image blocks and printed out.

In FIGS. 13 and 14, a page of expected output image is divided into 11 blocks (at equal intervals with respect to the developer's direction of conveyance) by 4 blocks (at equal intervals with respect to the direction perpendicular to the developer's direction of conveyance), in total, 44 blocks. However, the number of divisions should not be limited to this. For example, the length of the image block and that of the developer block in the developer's direction of conveyance may be equal.

Since the expected output image information has been previously written in image memory 32, it is possible to determine the predicted unit toner consumption for each image block of the expected output image beforehand based on the number or ratio of the expected output pixels occupying each image block.

In FIGS. 13 and 14, the developer's speed of conveyance and the print processing speed are designated so that each developer block supplies three pages of expected output images ("A", "B" and "C") in the period during which the developer block passes through the image forming width W.

An oblique line with an arrow (trace) DA, shown across the first to third pages in FIGS. 13 and 14, shows the trace of points where one developer block supplies toner to (consumes toner for) the three pages of expected output images while the block passes through the image forming width W. Accordingly, the image blocks (to be referred to hereinbelow as "print-designated image blocks") overlapping the trace DA are the blocks to which toner should be supplied (for example, the hatched areas in the first page of FIG. 13).

The toner consumption predictor determines the predicted first toner consumption, the amount of toner to be consumed by each developer block (1 to n) during the period in which the developer block passes through the image forming width W by summing up the predicted unit toner consumptions for individual print-designated image blocks, which are determined based on the developer's speed of conveyance in the toner circulating path and the print processing speed, over the image forming width.

Alternatively, the toner consumption predictor may be adapted to have a function of adding a predetermined weight to each print-designated image block when predicted unit toner consumptions for every print-designated image block are added up. For example, on the assumption that the diagonal length of the unit image block is assumed to be "1", the ratio of the length of the trace DA in each print-designated image block is regarded as a weighting coefficient and multiplied on the predicted unit toner consumption of the print-designated image block. Use of this weighting process makes it possible to determine the first predicted toner consumption in a more simple and precise manner. In the expected output image "A" of FIG. 14, "0.8", "0.2", "0.6" and "0.4" are shown as the weighting coefficients. It should be noted that the way of defining the weighting coefficient is not limited to the above method.

(Predicted Toner Consumption Storage)

The predicted toner consumption storage stores the first predicted toner consumption for each developer block, predicted by the toner consumption predictor. The first predicted toner consumption for each developer block may also be stored as the transition of the toner concentration in each developer block (equivalent to the transition T of the toner concentration during the period in which the second circulation is made, shown in FIGS. 9B, 10B, 11B and 12B). In the present embodiment, image memory 32 is used for this predicted toner consumption storage.

(Toner Concentration Estimator)

The toner concentration estimator, as shown in FIG. 6, determines a toner supply point estimate (B1 to Bn) for every developer block (1 to n) by subtracting the first predicted toner consumption from the sensor-detected toner concentration value for the corresponding developer block.

Further, the toner concentration estimator sets up a toner supply target value S in accordance with the toner supply point estimate B and the second predicted toner consumption of the toner that is expected to be used during the period in which each developer block (1 to n) makes the second round ((N+1)th round) of the toner circulating path.

For example, like a case in which a group of identical expected output images (a group of three expected output images in FIGS. 13 and 14) are repeatedly printed out a multiple number of times or other cases, there are cases where the developer blocks circulate several rounds through the toner circulating path during a single image processing job. In this case, in the present embodiment, since the period of time in which the developer makes one round of the toner circulating path is set to be an integer multiple of the print processing time for a single page of image forming, it is possible to identify the print-designated image blocks associated with the second round of each developer block (FIGS. 9 to 12). Accordingly, it is possible to determine the second predicted toner consumption from the thus identified print-designated image blocks.

There are various ways to determine the second predicted toner consumption from the identified print-designated image blocks. For example, if the first predicted toner consumption has been already recorded during the first circulation of the identified print-designated image blocks or during other occasions, the second predicted toner consumption can be determined by reading it from the predicted toner consumption storage and using that reading. Alternatively, the second predicted toner consumption for the identified print-designated image blocks may be calculated once again in the same manner as the above-described calculating method for the first predicted toner consumption (this is effective when the first predicted toner consumption does not remain in the predicted toner consumption storage). Further, it is also possible to determine the second predicted toner consumption based on the transition of the toner concentration during the first circulation of the identified print-designated image blocks.

By the above process, it is possible to determine the second predicted toner consumption of the toner that is expected to be used by the developer block located at point 135 where toner is supplied, across the image forming width W during the second circulation that follows.

Accordingly, the toner concentration estimator sets up toner supply target value S (see the following formula) so that the concentration that is obtained by subtracting the second predicted toner consumption that is expected to be used during the second circulation, from the sum of toner supply point estimate B and toner supply target value S (FIGS. 9B, 10B, 11B and 12B) to be supplied at toner supply point 135, is equal to or greater than the minimum target concentration M (FIGS. 9B, 10B, 11B and 12B) to guarantee normal printing. Here, the minimum target concentration M can be set at an arbitrary value equal to or greater than 0.

(Toner Supply Point Estimate B + Toner Supply Target Value S − Second Predicted Toner Consumption) ≧ Minimum Target Concentration M, or Toner Supply Target Value S ≧ (Minimum Target Concentration M − Toner Supply Point Estimate B + Second Predicted Toner Consumption).

In FIGS. 9B, 10B, 11B and 12B, symbol D designates the difference between the toner supply point estimate B after two circulations and the minimum target concentration M. Accordingly, it can be expressed that toner supply target value S is equal to or greater than the difference D.

Determining the above toner supply target value S makes it possible to positively avoid each developer block lacking toner while the developer block is moving through the image forming width W during the second circulation.

In the present embodiment, by adding this function to image controller 31, the image controller is used as the toner concentration estimator.

(Toner Supply Timing Determining Portion)

The toner supply timing determining portion has the function of determining the starting time and ending time of toner supply by toner supply device 14*a*, based on the developer's speed of conveyance in the toner circulating path, the toner supply point estimate B and toner supply target value S. In the present embodiment, by adding this function to engine controller 36, the engine controller is used as the toner supply timing determining portion.

(Toner Supply Controller)

The toner supply controller has the function of controlling toner supply by toner supply device 14*a*1 based on the determined result from the toner supply timing determining portion. In the present embodiment, by adding this function to engine controller 36, the engine controller is used as the toner supply controller.

Toner supply resultant estimate C may be replaced by the sensor-detected toner concentration value A for the second circulation. The toner concentration of each developer block at and after the second circulation may be detected by toner concentration sensor 14*a*3, and its difference from toner supply resultant estimate C is accumulated as an error, and the amount of toner supply may be adjusted based on the thus accumulated errors.

In connection with the above, the programs for causing image controller 31, engine controller 36 and others to execute the step of detecting toner concentration of each developer by means of toner concentration sensor 14*a*3, the step of storing sensor-detected toner concentration A for each developer block, the step of estimating the toner supply point estimate B, the step of determining the second predicted toner consumption, the step of setting up toner supply target value S, the step of determining the starting and ending times of toner supply, the step of controlling the toner supply from toner supply device 14*a*1 and the like, are stored in HDD 25.

Here, though the embodiment is described taking an example of image forming station 10*a*, other image forming stations 10*b* to 10*d* are also configured in the same manner.

Further, the above embodiment was described taking a job example in which one or more expected output images are repeatedly printed, but the embodiment is not limited to the above. For example, the first predicted toner consumption may be stored by performing trial print, then toner supply target value S may be set up based on the first predicted toner consumption stored in the toner supply estimate storage to execute a real printing job.

Next, the functions provided by the toner concentration storage, toner consumption predictor, predicted toner consumption storage, toner concentration estimator, toner supply timing determining portion, toner supply controller will be described with reference to a block diagram.

Figure 8:
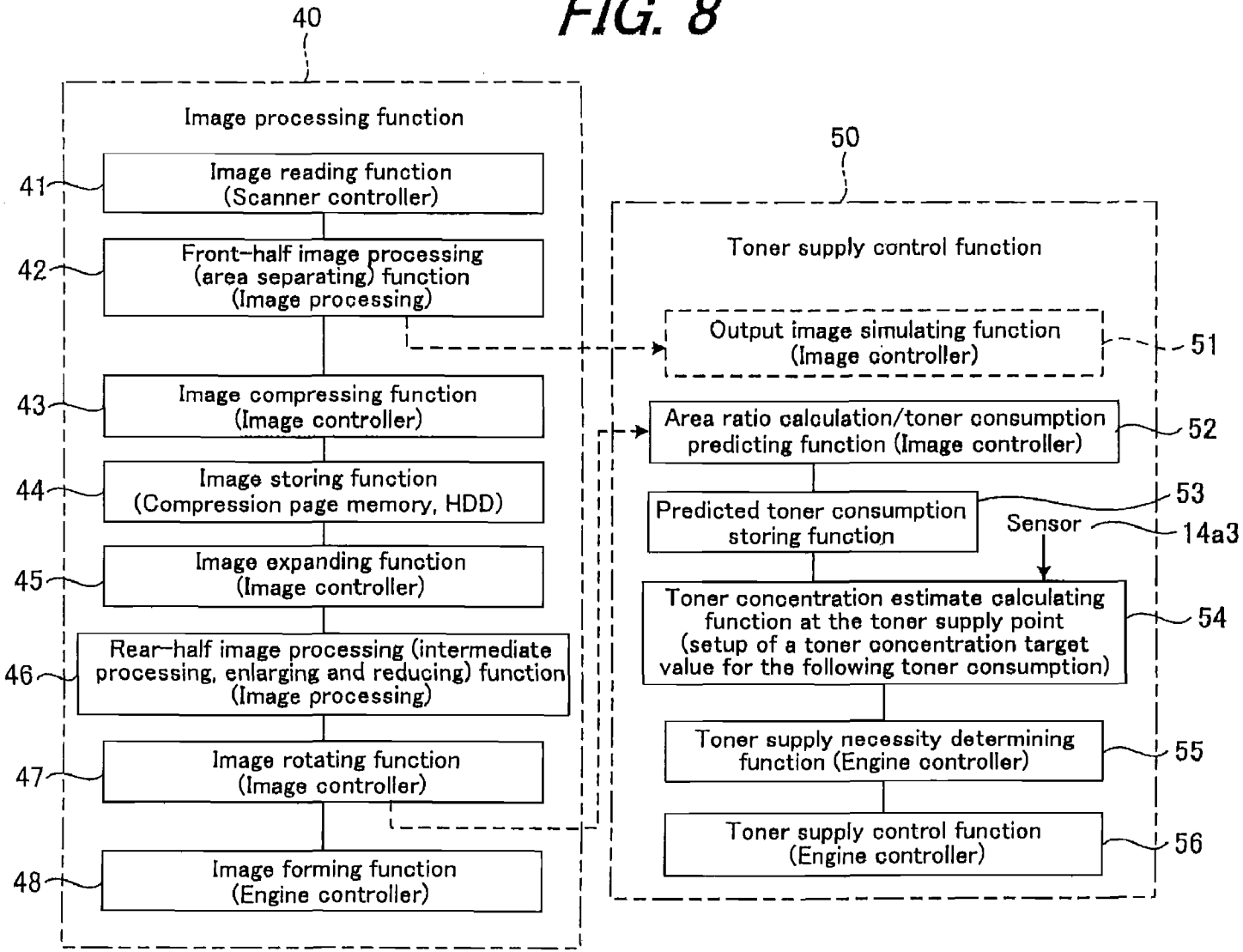
FIG. 8 is a block diagram for explaining the image processing function and toner supply control function for executing toner supply control of the digital color copier.

FIG. 8 is a block diagram for explaining the image processing function and toner supply control function for executing toner supply control of a digital color copier according to the present embodiment.

This embodiment is arranged so that toner supply control is performed in association with the image processing operation of the digital color copier.

The image processing and toner supply control in the digital color copier are executed based on image processing function 40 and toner supply function 50, as shown in FIG. 8.

Detailedly, image processing function 40 includes: an image reading function 41; a front-half image processing function 42; an image compressing function 43; an image storing function 44; an image expanding function 45; a rear-half image processing function 46; an image rotating function 47; and an image forming function 48.

Image reading function 41 is the function of reading the image of an original G by the scanner portion under control of scanner controller 34.

Front-half image processing function 42 is the function of separating the image area by means of an image processing LSI 33.

Image processing function 43 is the function of compressing the image by means of image controller 31.

Image storing function 44 is the function of writing an image into HDD 25 and image memory 32.

Image expanding function 45 is the function of expanding and compressing an image by image controller 31.

Rear-half image processing function 46 is the function of performing intermediate processes and image enlargement and reduction by means of image processing LSI 33.

Image rotating function 47 is the function of rotating an image by image controller 31.

Image forming function 48 is the function of forming an electrostatic latent image on the photoreceptor drum 11*a* surface by exposure unit 13*a* based on the image data that was image processed and stored in the memory and is transferred by way of engine controller 36.

Toner supply control function 50 includes: an output image simulating function 51; area ratio calculation/toner consumption predicting function 52, predicted toner consumption storing function 53; toner supply point toner concentration estimate calculating function 54; toner supply necessity determining function 55; and toner supply control function 56.

Output image simulating function 51 is the function of simulating an output image by means of image controller 31.

Area-ratio calculation/toner consumption predicting function 52 is the function provided by the toner consumption predictor, and predicts toner consumption using image controller 31, detailedly including estimation on toner consumption of each developer block (1 to n) for one circulation, from the image information stored in the image storage and to be used for printing, based on the developer's speed of conveyance in developing unit 14*a* and the print processing speed.

Predicted toner consumption storing function 53 is the function provided by the predicted toner consumption storage, and stores toner consumption predicted by the toner consumption predictor into image memory 32.

Toner supply point toner concentration estimate calculating function 54 is the function provided by the toner concentration estimator, and determines toner supply point estimates (B1 to Bn) at position 135 where toner is supplied, by subtracting the first predicted toner consumption from the sensor-detected toner concentration value for every developer block (1 to n). Further, toner concentration estimate calculating function 54 sets up toner supply target value S in accordance with toner supply point estimate B, second predicted toner consumption and minimum target concentration M.

Toner supply necessity determining function 55 is the function provided by the toner supply timing determining portion, and determines using engine controller 36, whether toner supply from toner supply device 14*a*1 is needed or not and the starting and ending times of toner supply, based on the developer's speed of conveyance inside developing unit 14*a*, toner supply point estimate B and the aforementioned toner supply target value S.

Toner supply control function 56 is the function provided by the aforementioned toner supply controller and controls toner supply using engine controller 36 in accordance with determined result by the toner supply timing determining portion.

The programs, data and the like based on which image controller 31 and engine controller 36 execute the above processes are stored in HDD (Hard disk) 25.

According to the present embodiment thus constructed as above, it is possible to perform optimal toner supply control in accordance with the output images.

Illustratively, in the digital color copier according to the present embodiment, the developer in the toner circulating path of developing unit 14*a* is divided virtually into a plurality of developer blocks (1 to n) so as to manage the positional information on developer blocks (1 to n) in the developer's toner circulating path.

As a result, the positions where toner is consumed, the position where toner concentration is detected and the position at which toner is supplied are correlated for every developer block (1 to n), hence if the consumption of toner differs at printing positions depending on the conditions of images to be printed, it is possible to perform optimal toner supply control by estimating the toner's conditions in the developer blocks in relation with the printing positions.

As shown in FIG. 6, as to the developer in the toner circulating path, it is possible to determine toner supply point estimate B, based on the sensor-detected toner concentration value A that is detected by toner concentration sensor 14*a*3 for every developer block (1 to n) and the first predicted toner consumption, predicted by the first toner consumption predictor (see expression (1) in FIG. 6).

Also, the sensor-detected toner concentration values and the first predicted toner consumptions for the developer blocks located before and after a specified developer block may be averaged to determine the toner supply point estimate B of the specified developer block (see expression (2) in FIG. 6).

Further, as shown in FIG. 7, it is possible to determine toner supply resultant estimate C for every developer block (1 to n), based on toner supply point estimate B and toner supply target value S (see expression (3) in FIG. 7).

Also, the toner supply point estimates B and toner supply target values S for the developer blocks located before and after a specified developer block may be averaged to determine the toner supply resultant estimate C of the specified developer block (see expression (4) in FIG. 7).

Further, when toner supply resultant estimate C is replaced by the next sensor-detected toner concentration value A, the difference therebetween may be accumulated as an error, so that the amount of toner supply can be adjusted based on the thus accumulated errors.

As has been described, according to the present embodiment, when the developer is circulated one round (the first circulation), based on the detected toner concentration for every developer block (1 to n) the first predicted toner consumption corresponding to the condition of the output images is predicted while toner supply point estimate B at the toner supply point is estimated. Based on these values the second predicted toner consumption, i.e., the amount of toner that is expected to be used when the developer is circulated another round (the second circulation) is determined for every developer block (1 to n) to estimate toner supply target value S. Accordingly, it is possible to ensure optimal toner concentration for every developer block (1 to n) in the future printing (during the second circulation).

As a result it is possible to constantly keep the density of the output images uniform even for large volume printing, hence realizing stable image output with high quality.

Next, how the consumption of toner may differ depending on the condition of the images will be described with reference to the drawings.

Figure 9A:
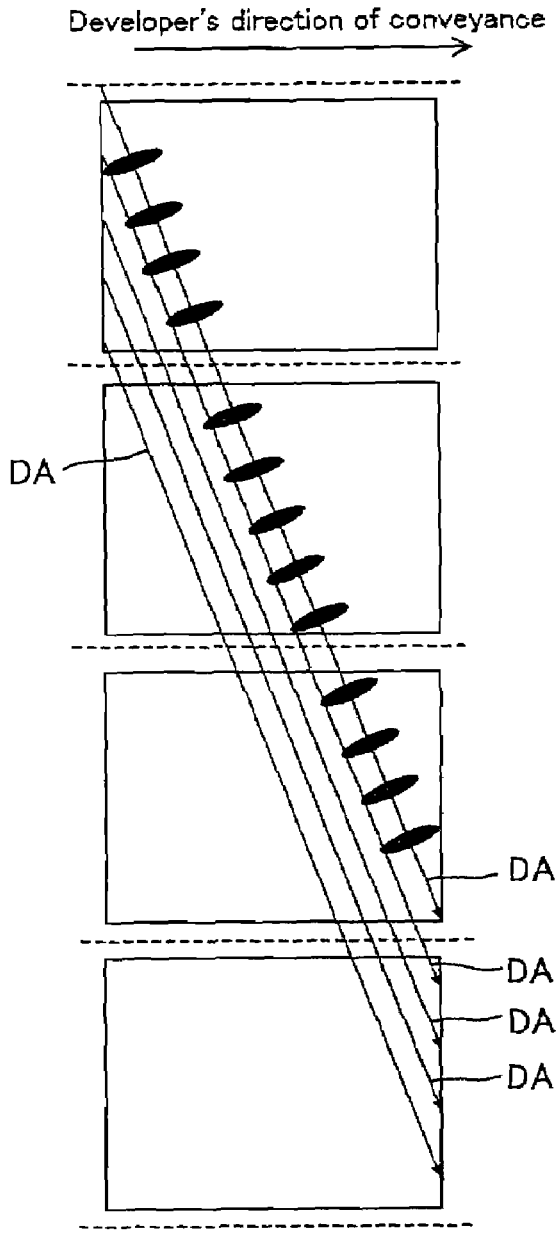
FIG. 9A is an illustrative view showing a printing status of images including a lower number of pixels as a whole.
Figure 9B:
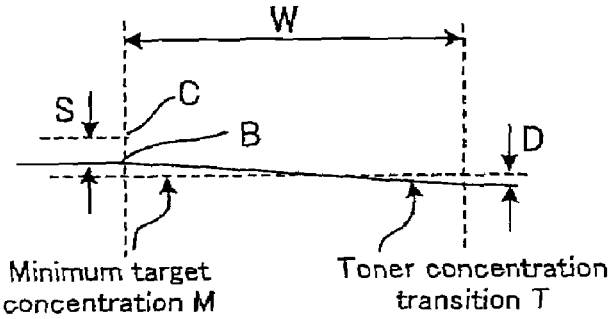
FIG. 9B is an illustrative view showing a transition T of toner concentration during the second circulation, relating to the printing status of FIG. 9A.
Figure 10A:
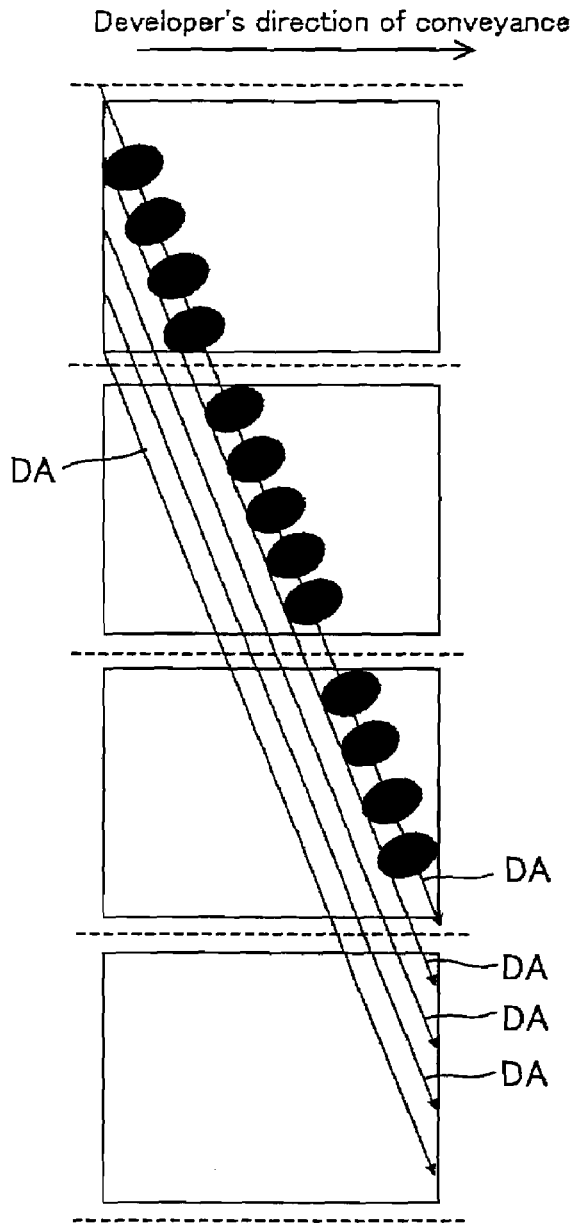
FIG. 10A is an illustrative view showing a printing status of images including a greater number of pixels as a whole.
Figure 10B:
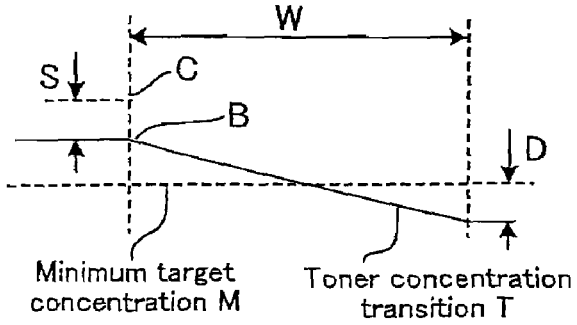
FIG. 10B is an illustrative view showing a transition T of toner concentration during the second circulation, relating to the printing status of FIG. 10A.
Figure 11A:
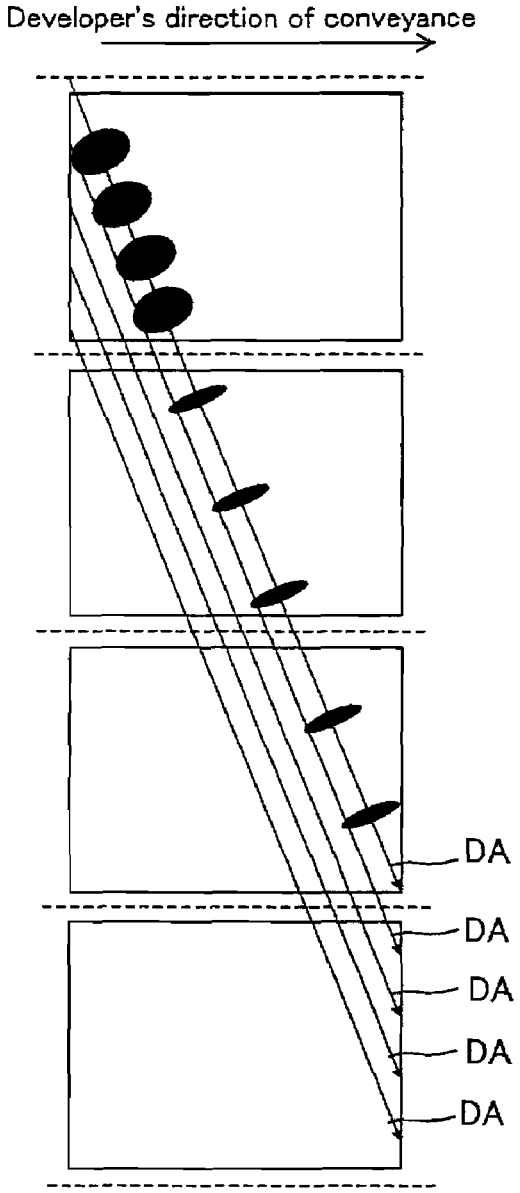
FIG. 11A is an illustrative view showing a printing status of images in which a large number of pixels exist on the upstream side with respect to the developer's direction of conveyance.
Figure 11B:
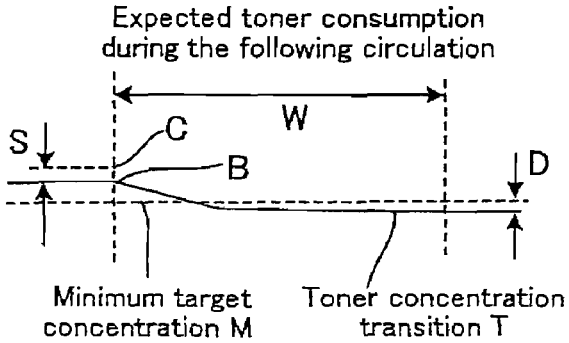
FIG. 11B is an illustrative view showing a transition T of toner concentration during the second circulation, relating to the printing status of FIG. 11A.
Figure 12A:
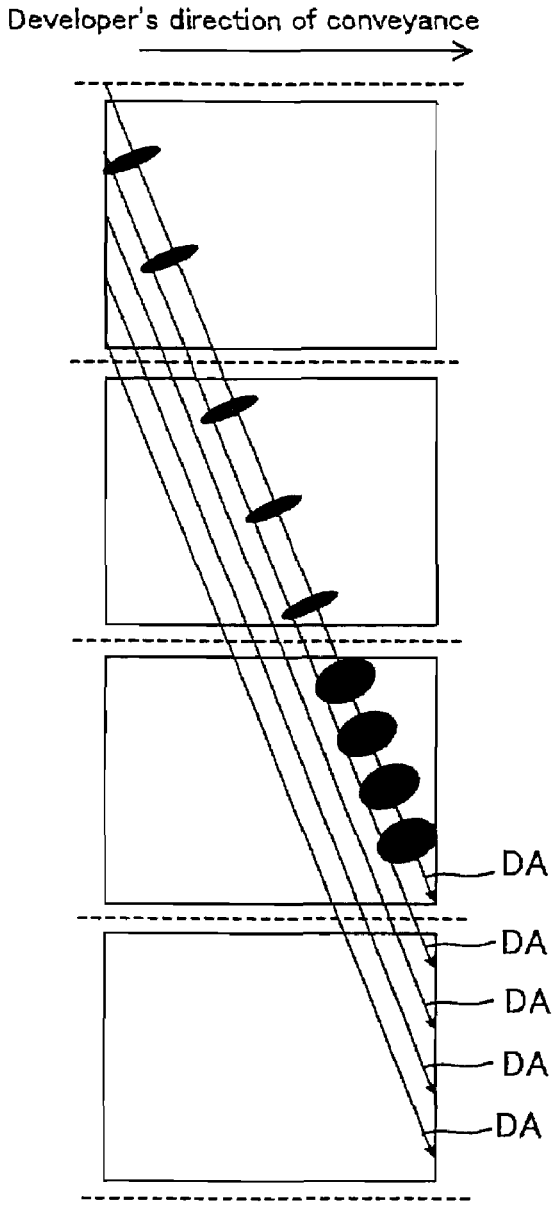
FIG. 12A is an illustrative view showing a printing status of images in which a large number of pixels exist on the downstream side with respect to the developer's direction of conveyance.
Figure 12B:
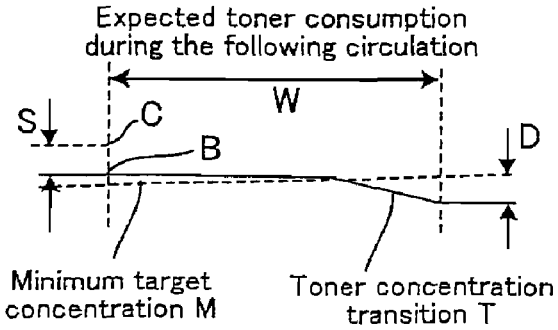
FIG. 12B is an illustrative view showing a transition T of toner concentration during the second circulation, relating to the printing status of FIG. 12A.

FIG. 9A is an illustrative view showing a printing status of images including a lower number of pixels as a whole, and FIG. 9B is an illustrative view showing a transition T of toner concentration during the second circulation, relating to the printing status of FIG. 9A. FIG. 10A is an illustrative view showing a printing status of images including a greater number of pixels as a whole, and FIG. 10B is an illustrative view showing a transition T of toner concentration during the second circulation, relating to the printing status of FIG. 10A. FIG. 11A is an illustrative view showing a printing status of images in which a large number of pixels exist on the upstream side with respect to the developer's direction of conveyance, and FIG. 11B is an illustrative view showing a transition T of toner concentration during the second circulation, relating to the printing status of FIG. 11A. FIG. 12A is an illustrative view showing a printing status of images in which a large number of pixels exist on the downstream side with respect to the developer's direction of conveyance, and FIG. 12B is an illustrative view showing a transition T of toner concentration during the second circulation, relating to the printing status of FIG. 12A.

As shown in FIG. 9A, when the images contain a lower number of pixels as a whole, transition T of toner concentration during the next one round tends to gently decrease approximately uniformly as the developer is conveyed from the upstream to downstream sides as shown in FIG. 9B.

As shown in FIG. 10A, when the images contain a greater number of pixels as a whole, transition T of toner concentration during the next one round tends to decrease approximately uniformly but more rapidly compared to the case of FIG. 9, as the developer is conveyed from the upstream to downstream sides, as shown in FIG. 10B.

As shown in FIG. 11A, when the images contain a greater number of pixels on the upstream side of the developer's direction of conveyance, transition T of toner concentration during the next one round tends to decrease rapidly in the area corresponding to the image area on the upstream side of the developer's direction of conveyance where a greater number of pixels exist and decease gently in the area corresponding to the image area on the downstream side of the developer's direction of conveyance where a lower number of pixels exist, as shown in FIG. 11B.

As shown in FIG. 12A, when the images contain a lower number of pixels on the upstream side of the developer's direction of conveyance, transition T of toner concentration during the next one round tends to decrease gently in the area corresponding to the image area on the upstream side of the developer's direction of conveyance where a lower number of pixels exist and decease rapidly in the area corresponding to the image area on the downstream side of the developer's direction of conveyance where a greater number of pixels exist, as shown in FIG. 12B.

The reason why transition T of toner concentration for each developer block can be predicted depends on that fact that it is possible to calculate the predicted unit toner consumption for each image block beforehand and that the delay time from the time when exposure unit 13*a* (FIG. 1) starts forming an electrostatic latent image on photoreceptor drum 11*a* to the time when the electrostatic latent image starts to be developed by developing roller 14*a*2 (FIG. 2) is known beforehand.

That is, the electrostatic latent image formed by exposure unit 13*a* is developed by developing roller 14*a*2 after the aforementioned delay time due to rotation of photoreceptor drum 11*a*. In this case, the toner consumed from developing roller 14*a*2 is the toner that was supplied from the developer of the developer block located at the position opposing the developing roller 14*a*2 the aforementioned delay time before due to rotation of developer roller 14*a*2.

Further, the angle of inclination of trace DA with respect to the developer's direction of conveyance is determined depending on the developer's speed of conveyance and the print processing speed (the speed at which an image is formed). The exact trace DA each developer block corresponds to is determined depending on the timing of the developer block being conveyed to the upstream end of image forming width W, the timing the aforementioned image data is exposed and the delay for the transfer from the developer block to the time toner is consumed.

According to the present invention, even if the condition of the toner consumption varies depending on the status of the images as described above, it is possible to estimate the toner supply target value S taking into consideration the second predicted toner consumption during the second circulation, and make toner supply control based on the estimated value. Accordingly, it is possible to perform optimal control of toner concentration at the second circulation.

What is claimed is:

1. An image forming apparatus comprising:

an image support on which an electrostatic latent image is formed;

a developing device for visualizing the electrostatic latent image by adhering toner to the electrostatic latent image on the image support by means of a developing roller;

an image storage for storing image information to be printed;

an exposure device for forming the electrostatic latent image on the image support in accordance with the image information stored in the image storage;

a toner concentration detector for detecting a toner concentration of a developer in the developing device;

a toner supply device for supplying the toner to the developing device based on the toner concentration obtained by the toner concentration detector, wherein the image forming apparatus is controlled so that the toner is supplied to the developing device in accordance with the amount of toner that has been consumed as an image output proceeds;

a toner concentration storage which, as to a plurality of developer blocks into which the developer that circulates in the developer device is virtually divided across an image forming width, stores the detected toner concentration of each developer block, detected by the toner concentration detector, separately for every developer block;

a toner consumption predictor for predicting a first predicted toner consumption of the toner that is expected to be consumed and/or was consumed from the developer of every developer block during the first circulation in accordance with the image information, based on a developer's speed of conveyance in the developing device and a print processing speed; and a toner concentration estimator for estimating, for every developer block, a toner supply point estimate as the toner concentration at a point where toner is supplied, by subtracting the first predicted toner consumption from the associated detected toner concentration and setting up a toner supply target value of the toner to be supplied from the toner supply device to the developing device in accordance with the predicted toner consumption during a second circulation that follows the first circulation, of the developer inside the developing device.

2. The image forming apparatus according to claim 1, further comprising:

a predicted toner consumption storage for storing the first predicted toner consumption, wherein the predicted toner consumption storage stores the first predicted toner consumption at the time of test printing, and the toner concentration estimator, at the time of real printing, sets up the toner supply target value based on the first predicted toner consumption stored in the predicted toner consumption storage.

3. The image forming apparatus according to claim 1, wherein the toner concentration estimator, based on a second predicted toner consumption of the toner that is expected to be consumed during the second circulation, sets up the toner supply target value.

4. The image forming apparatus according to claim 1, wherein the toner concentration estimator, based on a transition of the toner consumption during the second circulation, sets up the toner supply target value.

5. The image forming apparatus according to claim 1, wherein the toner consumption predictor, based on the predicted unit toner consumptions of individual image blocks into which expected output images are divided rectangularly and based on print-designated image blocks, for which toner is expected to be, and/or has been, consumed during the first circulation, and which are designated in accordance with the developer's speed of conveyance in the developing device and the print processing speed, sums up the predicted unit toner consumptions for the print-designated image blocks, to thereby estimate the first predicted toner consumption.

6. The image forming apparatus according to claim 5, wherein the toner consumption predictor adds a predetermined weight to each of the print-designated image blocks when summing up the predicted unit toner consumptions of the print-designated image blocks.

7. The image forming apparatus according to claim 5, wherein the developing device is designed such that a period of time in which the developer is conveyed and circulated one round inside the device is set to be an integer multiple of a print processing time required for image forming of a single page of expected output image.

8. The image forming apparatus according to claim 5, wherein the print-designated image blocks are determined based on a developer block's timing of conveyance, an exposure timing of image data in an image area and a time lag that is required for toner to transfer from each developer block and to be consumed.

9. The image forming apparatus according to claim 1, wherein the developing device includes a toner conveyor for agitating and conveying the developer stored therein in an axial direction of the developer roller; and the developing device has a toner input port for receiving toner from the toner supply device, at a position opposing the toner conveyor and located on an upstream side with respect to the toner's direction of conveyance.

10. The image forming apparatus according to claim 9, wherein the toner concentration detector is arranged at a position opposing the toner conveyor and located on a downstream side with respect to the toner's direction of conveyance.

11. The image forming apparatus according to claim 1, wherein the developer blocks of which the first predicted toner consumptions are predicted are identified based on a time interval from a start of forming the electrostatic latent image onto the image support to a start of developing the electrostatic latent image.

12. A toner supply control program for use in an image forming apparatus that comprises:

an image support on which an electrostatic latent image is formed;

a developing device for visualizing the electrostatic latent image by adhering toner to the electrostatic latent image on the image support by means of a developing roller;

an image storage for storing image information to be printed;

an exposure device for forming the electrostatic latent image on the image support in accordance with the image information stored in the image storage;

a toner concentration detector for detecting a toner concentration of a developer in the developing device; and a toner supply device for supplying the toner to the developing device based on the toner concentration obtained by the toner concentration detector, the toner supply program being executed to supply the toner to the developing device in accordance with an amount of toner that has been consumed as an image output proceeds, comprising:

for a plurality of developer blocks into which the developer that circulates in the developer device is virtually divided across an image forming width, a step of storing the detected toner concentration of each developer block, detected by the toner concentration detector, separately for every developer block;

a step of predicting the first predicted toner consumption of the toner that is expected to be consumed and/or was consumed from the developer of every developer block during a first circulation in accordance with the image information, based on a developer's speed of conveyance in the developing device and a print processing speed;

a step of estimating, for every developer block, a toner supply point estimate as the toner concentration at a point where toner is supplied, by subtracting the first predicted toner consumption from the associated detected toner concentration; and a step of setting up a toner supply target value of the toner to be supplied from the toner supply device to the developing device in accordance with the predicted toner consumption during a second circulation that follows the first circulation, of the developer inside the developing device.

* * * * *